US007319774B2

(12) United States Patent
Suzuki

(10) Patent No.: US 7,319,774 B2
(45) Date of Patent: Jan. 15, 2008

(54) SPEAKER

(75) Inventor: Tatsuya Suzuki, Yamagata (JP)

(73) Assignees: Pioneer Corporation, Tokyo (JP); Tohoku Pioneer Electric Corporation, Yamagata (JP)

( * ) Notice: Subject to any disclaimer, the term of this patent is extended or adjusted under 35 U.S.C. 154(b) by 490 days.

(21) Appl. No.: 11/070,288

(22) Filed: Mar. 3, 2005

(65) Prior Publication Data

US 2005/0196006 A1 Sep. 8, 2005

(30) Foreign Application Priority Data

Mar. 3, 2004 (JP) ..... P2004-059499

(51) Int. Cl.
*H04R 25/00* (2006.01)

(52) U.S. Cl. ..... 381/386; 381/392; 381/395

(58) Field of Classification Search ..... 381/86, 381/87, 332, 334, 345, 386, 389, 391, 392, 381/394, 395, 189, 152, 304, 305; 181/141, 181/150, 198, 199

See application file for complete search history.

(56) References Cited

U.S. PATENT DOCUMENTS 4,032,725 A * 6/1977 McGee ..... 381/395
6,577,741 B1 * 6/2003 Basore ..... 381/386
7,032,708 B2 * 4/2006 Popken et al. ..... 181/150

FOREIGN PATENT DOCUMENTS

JP 2003-289592 A 10/2003

* cited by examiner

*Primary Examiner*—Huyen Le
(74) *Attorney, Agent, or Firm*—Sughrue Mion, Pllc.

(57) ABSTRACT

A speaker includes: a speaker unit; a baffle fitted with the speaker unit; a cabinet fixed to the baffle, the cabinet covering a back of the speaker unit; a plurality of mounting bosses projected from at least one of the baffle and the cabinet; and a packing having elongated mounting holes, the packing located at an abutting part between the baffle and the cabinet, the packing sealing the abutting part. The abutting part includes a plurality of similar sealing areas, which are substantially common in size and shape as a whole except that at least one projecting position of the mounting boss is slightly shifted. The elongated mounting holes of the packing is used for the similar sealing areas. The elongated mounting holes of the packing correspond to the at least one projecting position of the mounting boss and compensate a position shift between the similar sealing areas.

3 Claims, 6 Drawing Sheets

SPEAKER

BACKGROUND OF THE INVENTION

1. Field of the Invention

The invention relates to a speaker.

2. Description of the Related Art

Conventionally, various types of speakers have been commonly used wherein a speaker has a baffle fitted with a speaker unit, and a cabinet that covers the back of the speaker unit and is screwed on the baffle (see JP-A-2003-289592).

Furthermore, a speaker having a packing for sealing an abutting part between the baffle and the cabinet is also known.

A speaker 1 shown in FIGS. 1 and 2 is a box-type woofer, which includes a baffle 3 fitted with a speaker unit 10, a cabinet 5 that covers an opening of the baffle 3 at the back of the speaker unit 10 and is screwed on the baffle 3, a plurality of screw hole bosses (mounting bosses) 11*a* to 11*e* and 12*a* to 12*e*, which are projected on the baffle 3 at an abutting part between the baffle 3 and the cabinet 5, and sound insulating packings 7 and 8, which are set between the baffle 3 and the cabinet 5 at the abutting part to seal the abutting part.

A sealing area formed on such an abutting part between the baffle 3 and the cabinet 5 takes the shape of a rectangular mold form. Meanwhile, a packing of a given shape is usually punched out of a sheet-like packing material. When the packing is punched out of such a material into a rectangular mold form, the yield of the packing material becomes low and a molding die is required to be larger, thus the manufacturing cost of the packing increases.

To suppress such a cost increase, the sealing area, which is of a rectangular mold form, is divided into two similar L-shaped sealing areas A and B, and a pair of the sound insulating packings 7 and 8, each having an almost L-shaped outline, are provided in correspondence to the L-shaped sealing areas A and B, as shown in FIG. 1.

Meanwhile, cylindrical screw hole bosses 11*a* to 11*e* and 12*a* to 12*e*, which are projected on the baffle 3, are often arranged to be non-symmetrical to each other in order to specify a mounting direction of the cabinet 5 to be screwed.

For example, as shown in FIG. 3, the projected positions of the screw hole bosses 11*a*, 11*b*, 11*c* and 12*a*, 12*b* and 12*c*, which are most of the entire screw hole bosses, are determined to be point symmetrical to each other in the two similar sealing areas A and B on the opening edge of the baffle 3, on which the sound insulating packings 7 and 8 are placed.

However, a gap Wa between the screw hole bosses 11*d* and 11*e* on one long side of the baffle 3 is made different from a gap Wb between the screw hole bosses 12*d* and 12*e* on the other long side of the baffle 3 in order to specify the mounting direction of the cabinet 5. As a result, the projected positions of the screw hole bosses 11*d* and 11*e* and that of screw hole bosses 12*d* and 12*e* are determined to be non-symmetrical in the similar sealing areas A and B, respectively.

Mounting holes 7*a* to 7*f* and 8*a* to 8*f* are formed on the sound insulating packings 7 and 8, respectively, and are made into a circular shape that correspond to the sectional shape of the screw hole bosses 11*a* to 11*e* and 12*a* to 12*e*, which are inserted into the mounting holes. To make adjustment for the difference in the projected positions between the screw hole bosses 11*d* and 11*e* on the one long side and the screw hole bosses 12*d* and 12*e* on the other long side, a gap between the mounting holes 7*d* and 7*e* on the sound insulating packaging 7 and a gap between the mounting holes 8*d* and 8*e* on the sound insulating packing 8 are made different in correspondence to the difference between the gap Wa and the gap Wb.

SUMMARY OF THE INVENTION

The above adjustment, however, makes the sound insulating packings 7 and 8 individual components for separate use even when the mounting holes 7*d* and 7*e* and 8*d* and 8*e* are formed at a position slightly shifted from a proper position while the overall outline and size of the packings 7 and 8 are almost the same.

For instance, as shown in FIG. 4, when the sound insulating packing 8, which is prepared for the similar sealing area B including the screw hole bosses 12*d* and 12*e* on the other long side, is placed for mounting on the similar sealing area A including the screw hole bosses 11*d* and 11*e* on the one long side, the screw hole bosses 11*d* and 11*e* cannot be inserted through the mounting hole 8*d* and 8*e*.

Hence considerable care is required in handling the sound insulating packings 7 and 8 upon assembling the speaker 1 lest similar but in fact separate packings 7 and 8 are mounted in a wrong manner. This leads to lower efficiency in assembling the speaker 1 and to a need of preparing a different molding die for each sound insulating packing 7 and 8 with the accompanying trouble of individual manufacturing controls, which makes it necessary to manufacture a number of types of packings in a small volume, thereby results in an increase in manufacturing costs.

It is an object of the invention to provide with a speaker including: a speaker unit; a baffle fitted with the speaker unit; a cabinet fixed to the baffle, the cabinet covering a back of the speaker unit; a plurality of mounting bosses projected from at least one of the baffle and the cabinet; and a packing having elongated mounting holes, the packing located at an abutting part between the baffle and the cabinet, the packing sealing the abutting part, wherein the abutting part includes a plurality of similar sealing areas, which are substantially common in size and shape as a whole except that at least one projecting position of the mounting boss is slightly shifted, wherein the elongated mounting holes of the packing is used for the similar sealing areas, and wherein the elongated mounting holes of the packing correspond to that at least one projecting position of the mounting boss and compensate a position shift between the similar sealing areas.

DESCRIPTION OF THE PREFERRED EMBODIMENTS

Figure 1:
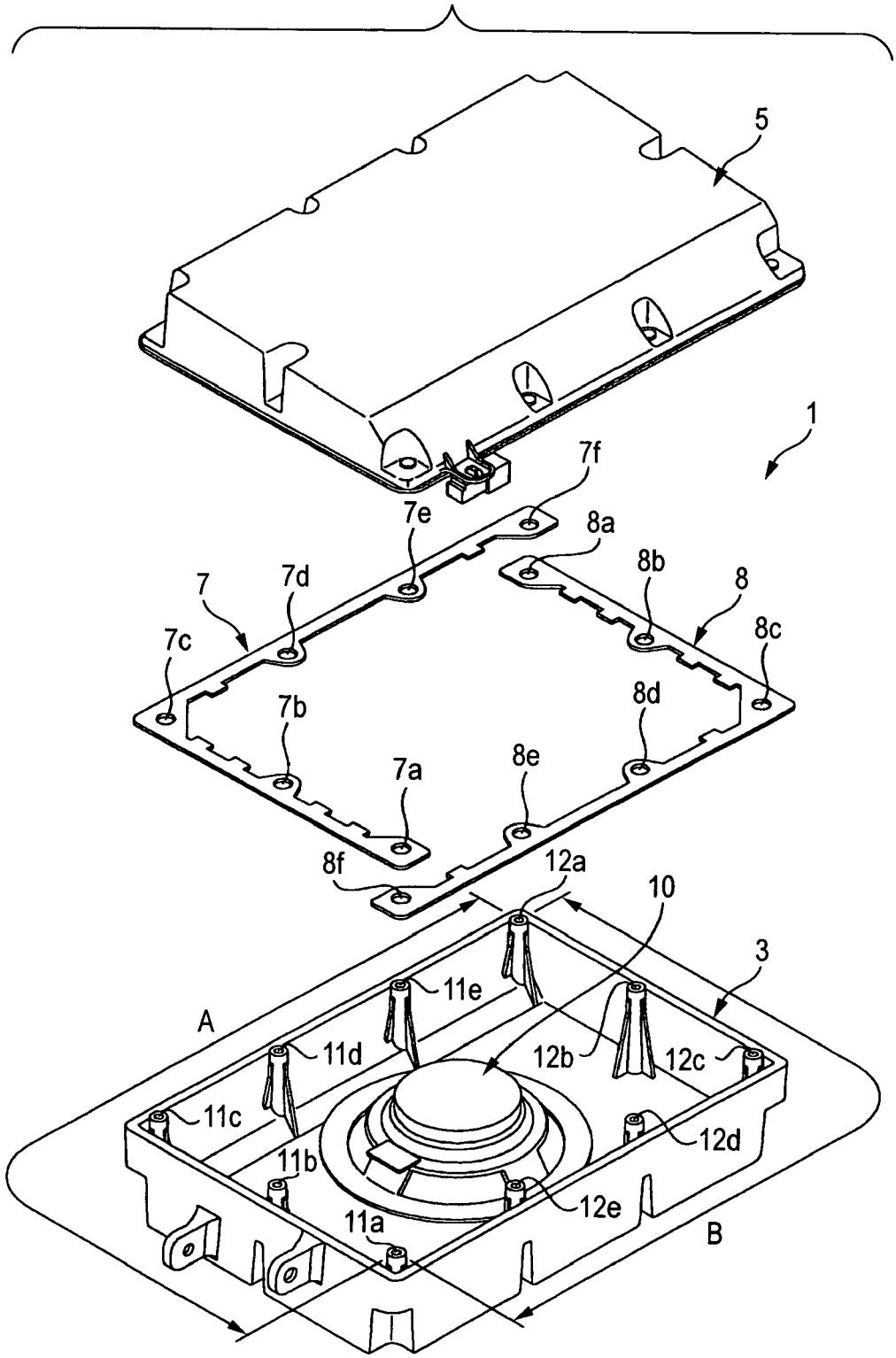
FIG. 1 RELATED ART
FIG. 1 is an exploded perspective view of a speaker according to the related art.
Figure 2:
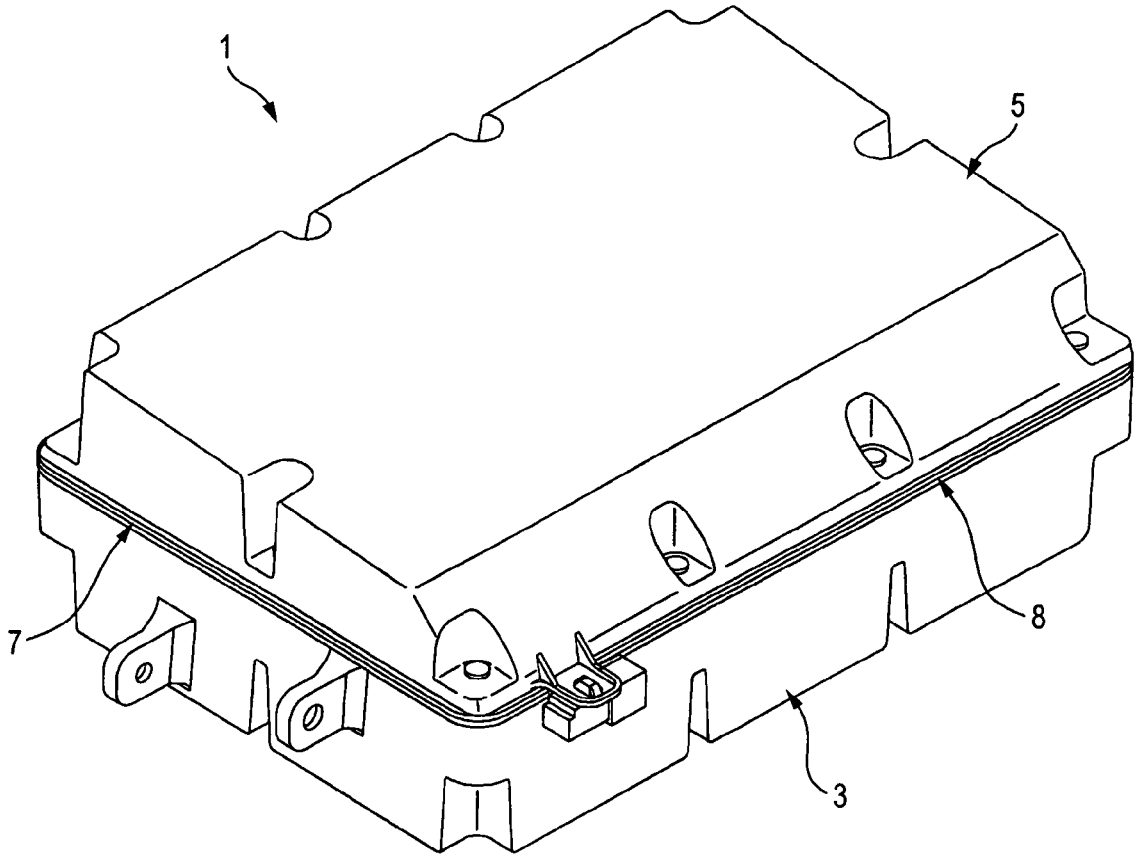
FIG. 2 RELATED ART
FIG. 2 is an assembly perspective view of the speaker shown in FIG. 1.
Figure 3:
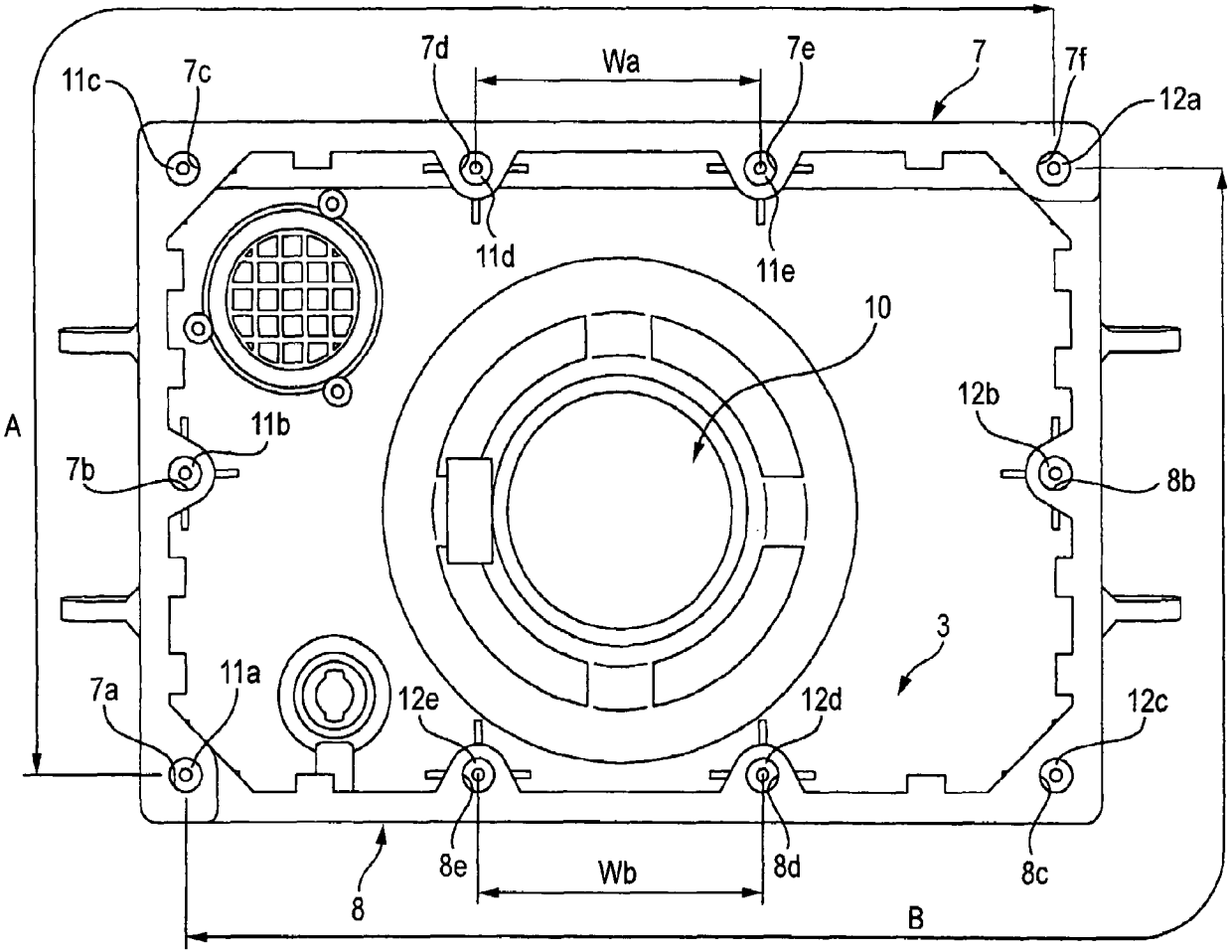
FIG. 3 RELATED ART
FIG. 3 is a top view for depicting the sound insulating packings that are placed on the baffle shown in FIG. 1.
Figure 4:
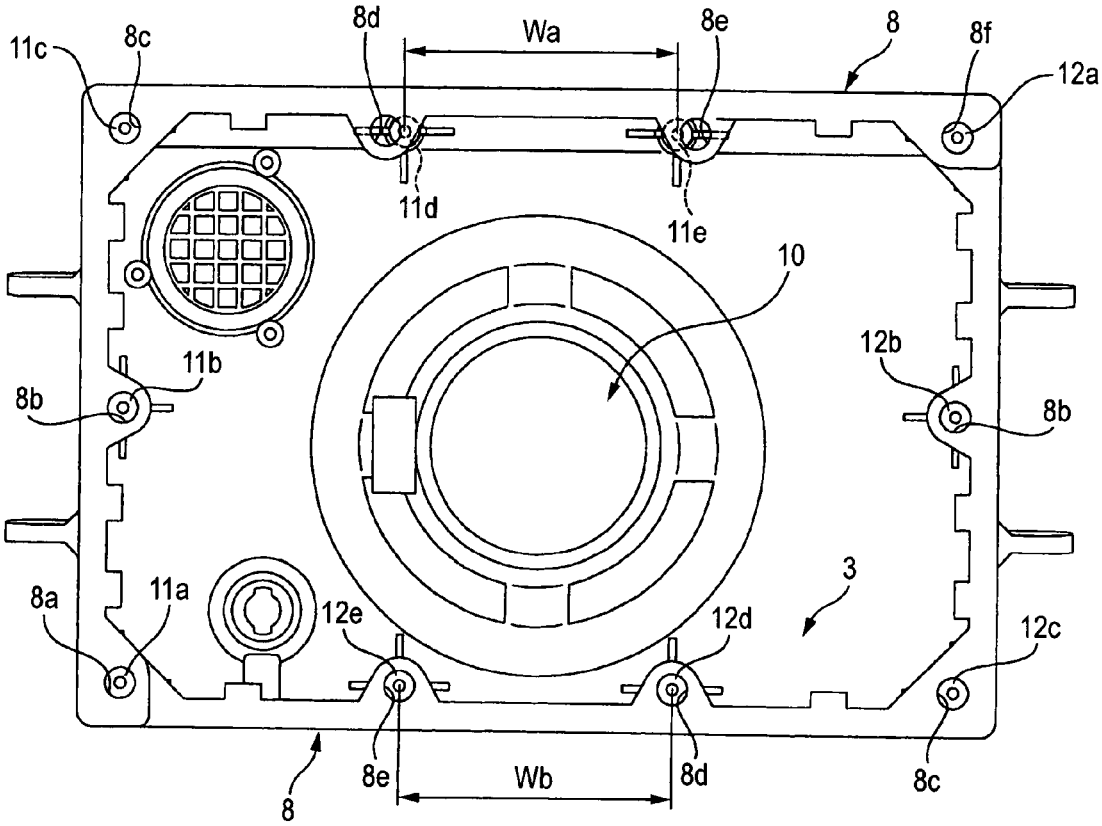
FIG. 4 RELATED ART
FIG. 4 is a top view for depicting the sound insulating packings that are placed on the baffle shown in FIG. 3 in an incorrect manner.

The following is a description the speaker according to an embodiment of the invention.

The speaker includes the baffle fitted with the speaker unit, the cabinet that covers the back of the speaker unit and is fixed to the baffle, the mounting bosses that are projected on either one of the baffle and the cabinet at the abutting part between the baffle and the cabinet, and the packing that is set between the baffle and the cabinet at the abutting part to seal the abutting part. The abutting part includes the similar sealing areas, which are almost common in size and shape as a whole except that the projected positions of some of the mounting bosses are slightly shifted in the similar sealing areas. The packing has elongated mounting holes, which correspond to some of the mounting bosses and compensate the projected positions shift of some of the mounting bosses between the similar sealing areas. The packing consists of packings identical in outline and shape, which are employed for the similar sealing areas.

Since the packing held between the baffle and the cabinet at the abutting part for sealing has the elongated mounting holes, which correspond to some of the mounting bosses slightly shifted in their projected positions and compensate the projected positions shift of some of the mounting bosses between the similar sealing areas, it is no longer required to manufacture a specific packing having mounting holes formed at modified positions corresponding to each similar area in adjustment for the slight position shift of some of the mounting bosses. At the same time, restriction on a mounting direction of the packing is also eliminated.

As a result, the types of packings to be manufactured can be reduced for cost reduction. Also, there will be less trouble of having to identify many types of similar packings or of paying attention to a mounting direction of individual packings upon assembling the speaker, thus, efficiency in assembling will be improved.

In addition, since the abutting part is formed into a rectangular shape while the packing consists of the packings each having an almost L-shaped outline, each packing of identical shape is punched out of a sheet-like packing material for the abutting part. This improves the yield of the packing and miniaturizes a molding die, thus reducing the manufacturing cost of the packing.

The following is a detailed description of a speaker according to one embodiment of the invention. The speaker is described referring to the drawings.

Figure 5:
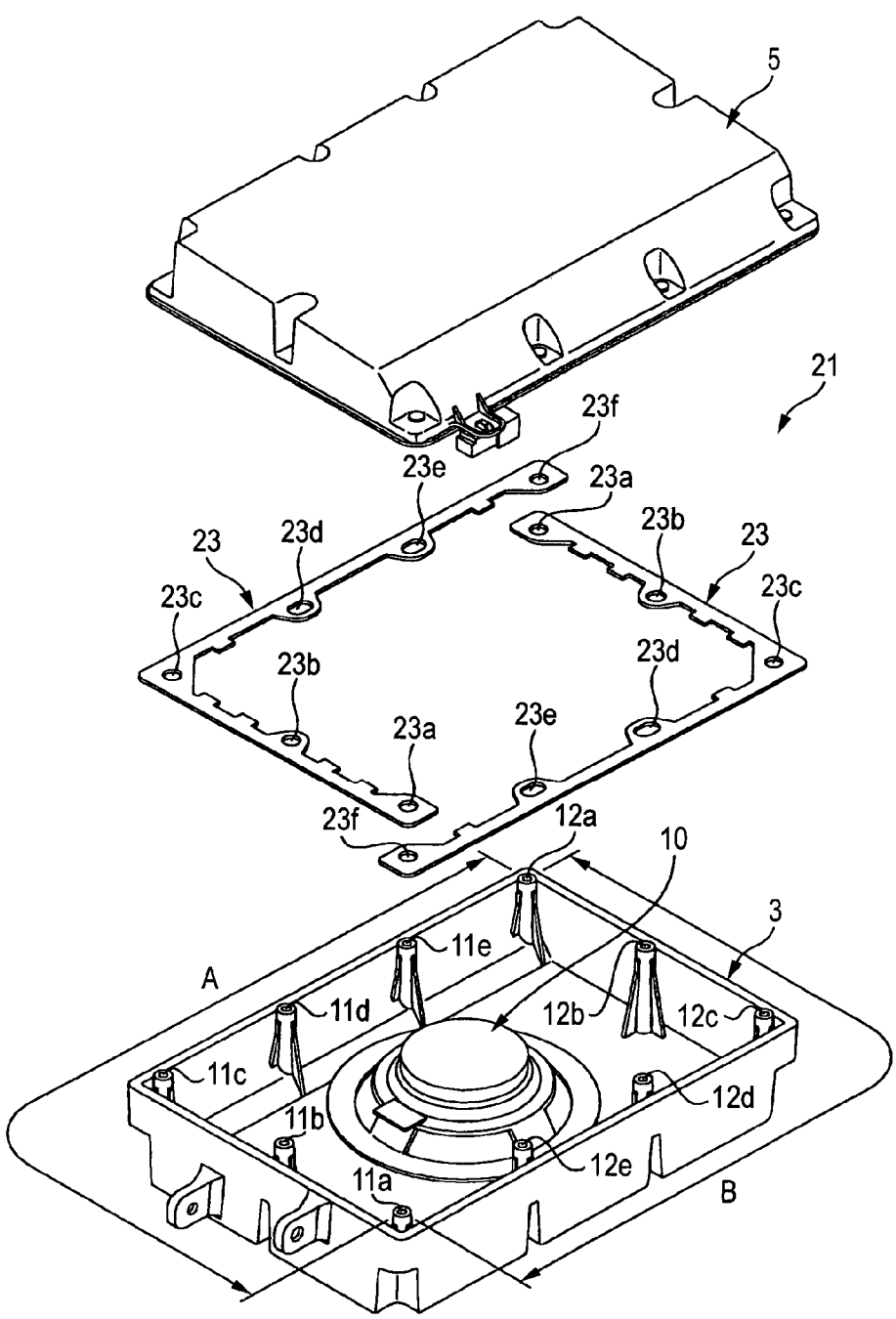
FIG. 5 is an exploded perspective view of the speaker according to one embodiment of the invention.
Figure 6:
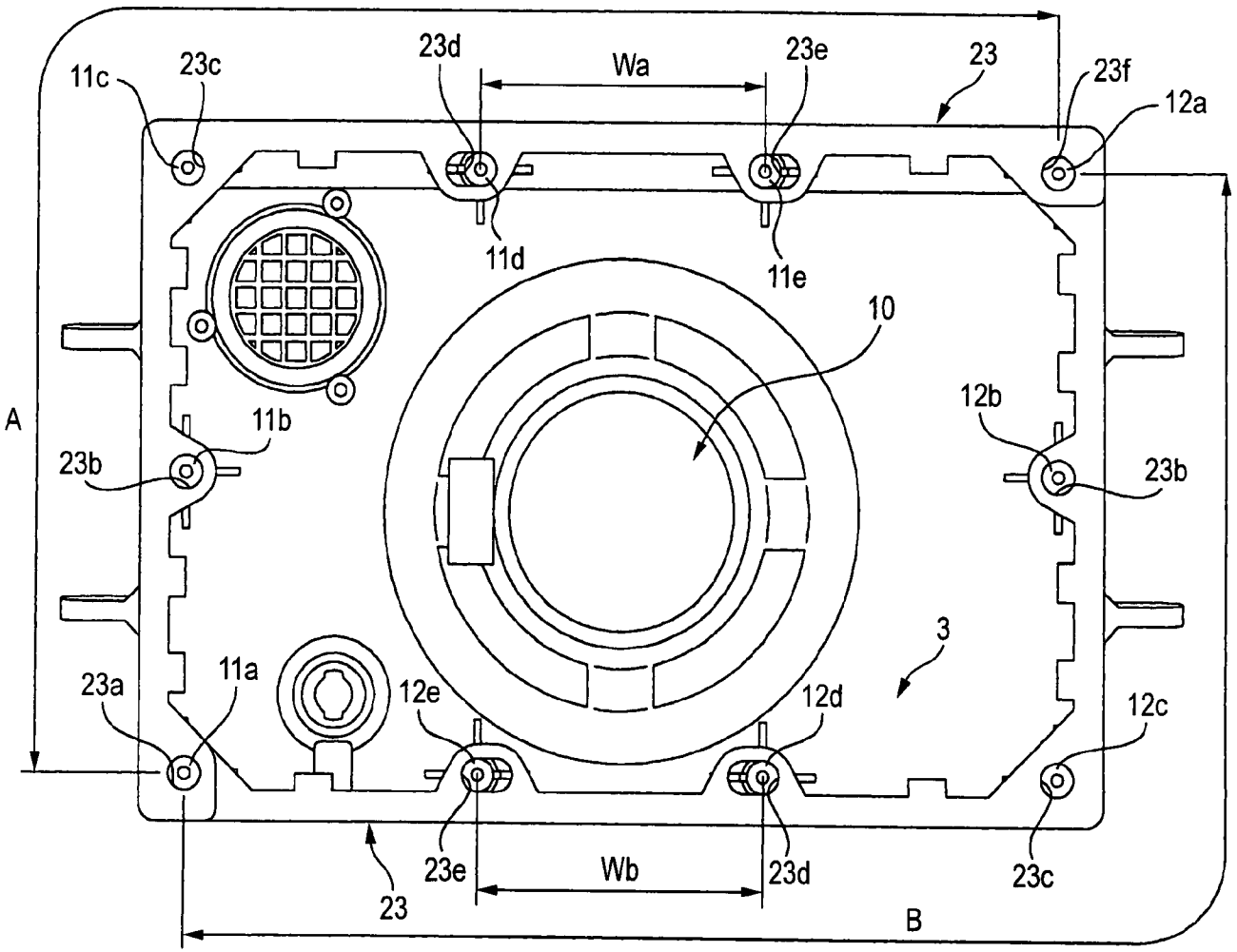
FIG. 6 is a top view for depicting the sound insulating packings that are placed on the baffle shown in FIG. 5.

FIG. 5 is an exploded perspective view of the speaker according to one embodiment of the invention. FIG. 6 is a top view for depicting sound insulating packings placed on the baffle shown in FIG. 5.

As shown in FIG. 5, the speaker 21 according to this embodiment is a box-type woofer, which includes the baffle 3 fitted with the speaker unit 10, the cabinet 5 that covers the opening of the baffle 3 at the back of the speaker unit 10 and is screwed on the baffle 3, a plurality of screw hole bosses (mounting bosses) 11*a* to 11*e* and 12*a* to 12*e*, which are projected on the baffle 3 at the abutting part between the baffle 3 and the cabinet 5, and a pair of sound insulating packings 23 (packings)and 23, which are set between the baffle 3 and the cabinet 5 at the abutting part to seal the abutting part.

The projected positions of the screw hole bosses 11*a*, 11*b*, 11*c* and 12*a*, 12*b* and 12*c*, which are most of the entire screw hole bosses, are determined to be point symmetrical to each other in the two similar sealing areas A and B on the opening edge of the baffle 3, on which the sound insulating packings 23 and 23 are placed, as shown in FIGS. 5 and 6.

However, the gap Wa between the screw hole bosses 11*d* and 11*e* on one long side of the baffle 3 is made different from the gap Wb between the screw hole bosses 12*d* and 12*e* on the other long side of the baffle 3 in order to specify a mounting direction of the cabinet 5. In other words, among all the screw hole bosses, only the screw hole bosses 11*d* and 11*e* and 12*d* and 12*e* are slightly shifted to each other in their projected positions. As a result, the projected positions of the screw hole bosses 11*d* and 11*e* and that of screw hole bosses 12*d* and 12*e* are determined to be non-symmetrical in the similar sealing areas A and B, respectively.

Meanwhile, each sound insulating packing 23 has an almost L-shaped outline, which corresponds to each L-shaped similar sealing area A and B that is given by dividing the sealing area of a rectangular mold form. This improves the yield of the sound insulating packing 23 upon punching it out of a sheet-like packing material, miniaturizes a molding die, and thus reduces the manufacturing cost of the packing.

Mounting holes 23*a*, 23*b*, 23*c* and 23*f* are formed on the sound insulating packings 23 and 23, respectively, and are made into a circular shape that correspond to the sectional shape of the screw hole bosses 11*a* to 11*c* and 12*a* to 12*c*, which are inserted into the mounting holes.

On the other hand, mounting holes 23*d* and 23*e* of the sound insulating packing 23, into which either pair of the screw hole bosses 11*d* and 11*e* and 12*d* and 12*e* arranged to be non-symmetrical in their projected positions to each other in the similar sealing areas A and B are inserted, are formed to be elliptic elongated holes. The elongated shape of the mounting holes 23*d* and 23*e* compensates a position shift between the mounting holes 23*d* and 23*e* between the similar sealing areas A and B.

As shown in FIG. 6, the length of the major axis of the mounting holes 23*d* and 23*e* is preset. Because of the preset major axis, a gap between the centers of respective one arcs of the mounting holes 23*d* and 23*e* that are adjacent to each other correspond to the gap Wa between the screw hole bosses 11*d* and 11*e*, while that of respective other arcs of the mounting holes 23*d* and 23*e* that are further apart from each other correspond to the gap Wb between the screw hole bosses 12*d* and 12*e*.

According to the speaker 21 of this embodiment, the sound insulating packings 23 held between the baffle 3 and the cabinet 5 at the abutting part for sealing have the elongated mounting holes 23*d* and 23*e*, which correspond to specific screw hole bosses 11*d* and 11*e* and 12*d* and 12*e* slightly shifted in their projected positions and compensate the positions shift of the mounting holes 23*d* and 23*e* between the similar sealing areas A and B.

Therefore, the speaker 21 eliminates the need of providing two separate types of sound insulating packings 7 and 8, which have the mounting holes 7*d* and 7*e* and 8*d* and 8*e* formed at altered positions, respectively, in correspondence to each similar sealing areas A and B, in order to compensate the slight position shift between the screw hole bosses 11*d* and 11*e* and 12*d* and 12*e* (see FIG. 5). Manufacturing one type of the sound insulating packing 23 will suffice. Thus the number of types of packings to be manufactured is reduced to slash costs.

Additionally, respective mounting holes 23*a* to 23*f* on the sound insulating packing 23 are arranged to be axisymmetrical with respect to the center line of the long side or of the short side of the insulating packing 23. This eliminates restriction on a mounting direction of the packing 23 when it is placed on the opening edge of the baffle 3. Accordingly, in assembling the speaker 1, there will be less trouble of identifying a plurality of types of similar sound insulating packings or of paying attention to the mounting direction, thus assembling efficiency is improved.

It will be appreciated that the composition of the speaker unit, baffle, cabinet, mounting bosses, and packings according to the speaker of the invention is not limited to the same according to the speaker 21. The composition of those elements may vary as long as it is within the true scope of this invention.

Also, while the sealing area of the rectangular mold form is divided into the two L-shaped similar sealing areas A and B in the speaker 21, the embodiment of the invention regarding the sealing area is not limited to the above embodiment.

In adjustment for an abutting part of a certain size between the baffle 3 and the cabinet 5, the sealing area of the rectangular mold form may be divided into four areas corresponding to each four sides of the baffle, and two types of sound insulating packings, each used separately for the long sides and short sides, are employed to seal the abutting part.

The packing of the embodiment of the invention has the mounting holes that correspond to a plurality of the similar sealing areas, which are almost common in size and shape as a whole except that the projected positions of particular screw hole bosses 11*d* and 11*e* and 12*d* and 12*e* are slightly shifted in the similar sealing areas. As such a packing, a sound insulating packing formed into a rectangular mold form is not excluded from the scope of the invention, and offers approximately the same effect as the sound insulating packing 23, except for a low yield due to a process of being punched out of a sheet-like packing material.

According to the embodiment of the speaker 21, the two similar sealing areas A and B, in which only the projected positions of particular screw hole bosses 11*d* and 11*e* and 12*d* and 12*e* are slightly shifted, are formed on the single baffle 3. The packing of the embodiment of the invention, however, can also apply to a stereo speaker system or the like, in which a plurality of similar sealing areas are formed on different baffles of left and right speakers.

Further, the baffle 3 and the cabinet 5 can be fixed together by heat welding, using welding bosses, which work as mounting bosses, projected on the baffle 3, instead of using the screw hole bosses 11*a* to 11*e* and 12*a* to 12*e* for screwing the cabinet 5 on the baffle 3.

What is claimed is:

1. A speaker comprising:

a speaker unit;

a baffle fitted with the speaker unit;

a cabinet fixed to the baffle, the cabinet covering a back of the speaker unit;

a plurality of mounting bosses projected from at least one of the baffle and the cabinet; and a packing having elongated mounting holes, the packing located at an abutting part between the baffle and the cabinet, the packing sealing the abutting part, wherein the abutting part includes a plurality of similar sealing areas, which are substantially common in size and shape as a whole except that at least one projecting position of the mounting boss is slightly shifted, wherein the elongated mounting holes of the packing are used for the similar sealing areas, and wherein the elongated mounting holes of the packing correspond to the at least one projecting position of the mounting boss and compensate a position shift between the similar sealing areas.

2. The speaker according to claim 1, wherein the abutting part is formed into a rectangular mold form, and wherein the packing is configured by a pair of packings each having an almost L-shaped outline.

3. A speaker comprising:

a speaker unit;

a baffle fitted with the speaker unit;

a cabinet fixed to the baffle, the cabinet covering a back of the speaker unit;

a plurality of mounting bosses projected from at least one of the baffle and the cabinet; and a pair of packings each having an almost L-shaped outline, the packings having elongated mounting holes, the packings located at at least one abutting part formed into a rectangular mold form between the baffle and the cabinet, the packings sealing the abutting part, wherein the abutting part includes a plurality of similar sealing areas, which are substantially common in size and shape as a whole except that at least one projecting position of the mounting boss is slightly shifted, wherein the elongated mounting holes of the packings are used for the similar sealing areas, wherein the elongated mounting holes of the packings correspond to the at least one projecting position of the mounting boss and compensate a position shift between the similar sealing areas.

* * * * *